US011805956B2

(12) United States Patent
Fritsch

(10) Patent No.: US 11,805,956 B2
(45) Date of Patent: Nov. 7, 2023

(54) DRYING AND/OR CLEANING CLOTH

(71) Applicant: Jens Fritsch, Bornheim (DE)

(72) Inventor: Jens Fritsch, Bornheim (DE)

(73) Assignee: Jens Fritsch, Bornheim (DE)

( * ) Notice: Subject to any disclaimer, the term of this patent is extended or adjusted under 35 U.S.C. 154(b) by 377 days.

(21) Appl. No.: 17/144,433

(22) Filed: Jan. 8, 2021

(65) Prior Publication Data

US 2021/0212545 A1 Jul. 15, 2021

(30) Foreign Application Priority Data

Jan. 9, 2020 (DE) ..... 202020100103.5

(51) Int. Cl.
*A47L 13/18* (2006.01)
*A47L 13/16* (2006.01)
*A47L 17/08* (2006.01)

(52) U.S. Cl.
CPC ..... *A47L 13/18* (2013.01); *A47L 13/16* (2013.01); *A47L 17/08* (2013.01)

(58) Field of Classification Search
CPC ..... A47L 13/16; A47L 17/08; A47L 13/18
See application file for complete search history.

(56) References Cited

U.S. PATENT DOCUMENTS 6,019,854 A 2/2000 Thomas
2001/0047534 A1* 12/2001 Sandusky ..... A41D 19/01 2/158
2011/0177743 A1* 7/2011 Maranghi ..... B32B 3/28 28/107
2019/0015875 A1* 1/2019 Gardner, Jr. ..... D04H 1/4374
2021/0121037 A1 4/2021 Fritsch

FOREIGN PATENT DOCUMENTS

DE 202019105895 U1 11/2019
DE 3811839 A1 4/2021
JP 2002159427 A 6/2002

OTHER PUBLICATIONS

European Search Report—Corresponding EP Application No. 21150357.8—dated May 25, 2021.

* cited by examiner

*Primary Examiner* — Michael D Jennings
(74) *Attorney, Agent, or Firm* — Calderon, Safran & Cole P.C.

(57) ABSTRACT

Drying and/or cleaning cloth has an elongated shape with a double-layered construction. Two sides are formed by cloth layers with an interior region in-between. The two sides are each bounded by two parallel longitudinal edges and two transverse edges. An opening is for reaching into the interior region between the two sides. The drying and/or cleaning cloth has a pentagonally configured region. In the pentagonally configured region one of the two transverse edges is aligned at right angles to the longitudinal edges and the other of the two transverse edges is formed by two angularly abutting front edge sections adjoining the corresponding longitudinal edges at an obtuse angle. The opening for reaching into the interior region between the two sides is provided in the region of the transverse edge aligned at right angles to the longitudinal edges.

17 Claims, 2 Drawing Sheets

DRYING AND/OR CLEANING CLOTH

CROSS-REFERENCE TO RELATED APPLICATIONS AND CLAIM TO PRIORITY

This application is related to utility model application no. 20 2020 100 103.5, filed Jan. 9, 2020 in the Federal Republic of Germany, the disclosure of which is incorporated herein by reference and to which priority is claimed.

FIELD OF THE INVENTION

The invention concerns a drying and/or cleaning cloth with an elongated shape with a double-layered construction with two sides each formed by cloth layers and an interior region located in-between, where the two sides are respectively bounded by two parallel longitudinal edges and two transverse edges and where an opening is provided between the two sides for reaching into the interior region.

BACKGROUND OF THE INVENTION

Such drying and/or cleaning cloths are known from experience, used inter alia for the drying of motor vehicles after vehicle washing or for absorbing polishing agent residues.

Such drying and/or cleaning cloths are also utilized for household cleaning or for drying domestic animals.

The drawback here is that during the previously described activities it can happen that the drying and/or cleaning cloth inadvertently falls down and thus comes into contact with the ground. As a result of this, dirt can end up on the cloth which then during further use can not only for example (re-)contaminate the vehicle, but scratches or other damage to the vehicle can be caused by hard constituents such as grains of sand, small stones, etc. The same also applies analogously during household use and similarly also during utilization for the drying of domestic animals, which likewise can be affected negatively. Larger drying and/or cleaning cloths are also known, which however do not exhibit an interior region into which a hand can be inserted for better handling. Hence the drying and/or cleaning cloth has to be held from the outside, which impedes accurate guiding of the drying and/or cleaning cloth during use.

The task of the invention is to avoid the aforementioned drawbacks and to propose a drying and/or cleaning cloth with which the risk of impairments due to inadvertent dropping of the drying and/or cleaning cloth is reliably avoided and more accurate guiding of the drying and/or cleaning cloth during use is made possible.

SUMMARY OF THE INVENTION

This task is solved in a generic drying and/or cleaning cloth by the drying and/or cleaning cloth having a pentagonally configured region, in particular being formed solely by this region, whereby in the pentagonally configured region one of the two transverse edges is aligned at right angles to the longitudinal edges and the other of the two transverse edges is formed by two angularly abutting front edge sections, respectively adjoining the corresponding longitudinal edges at an obtuse angle, where the opening for reaching into the interior region between the two sides is provided in the region of the transverse edge aligned at right angles to the longitudinal edges.

Preferably at least one opening can have a length of ca. 5 cm to 15 cm, preferably 8 cm to 12 cm, most preferably ca.

10 cm, so that for one thing, reaching into the interior region is possible for usual hand dimensions, and for another, is configured as small as possible and thus the shape stability of the drying and/or cleaning cloth is impaired as little as possible by the opening.

According to the invention, at least one opening can be arranged approximately centrally in relation to the corresponding transverse edges and exhibit the same distance to each of the corresponding longitudinal edges.

In a preferred embodiment example of the invention, the drying and/or cleaning cloth can have two pentagonally configured regions, which each with their respective transverse edge that is aligned at right angles to the longitudinal edges abut each other and are joined to each other.

At the same time at least one of the two sides of the two pentagonally configured regions of the drying and/or cleaning cloth can be configured in one piece and continuously, preferably both sides of the two pentagonally configured regions of the drying and/or cleaning cloth can each be configured in one piece and continuously. As a result, each side of the drying and/or cleaning cloth is therefore configured respectively as a one-piece and continuous layer.

Advantageously, the opening can be provided centrally in relation to the longitudinal extension of the drying and/or cleaning cloth, such that the two part-regions located in front or behind the opening in the longitudinal direction are at least approximately of the same size.

According to the invention, the opening can be formed by a slit through both sides of the drying and/or cleaning cloth and both sides can thus respectively exhibit two free slit edges. As a result, the openings in the two sides are congruent.

Advantageously, the outer slit edge of one side of one pentagonal region can be sewn to the outer slit edge of the other side of the other pentagonal region. As a result, one side of one pentagonal region is then configured to be directly merging into the other side of the other pentagonal region, and on each side it is possible to reach into the interior region only in one direction. Thereby, the part-regions of the interior region into each of which it is possible to reach, are different for the two sides. Hence every part-area of the drying and/or cleaning cloth is usable through appropriate reaching in and where necessary turning down a part-region of the drying and/or cleaning cloth.

Furthermore, at least one side of the drying and/or cleaning cloth can have a fleece surface, where preferably both sides of the drying and/or cleaning cloth can each have a fleece surface. This results in good sliding on the area to be treated.

Thereby every side that exhibits a fleece side can be designed with this fleece side facing outward. Hence a simple material with only one fleece side can be used for the drying and/or cleaning cloth and nevertheless two fleece sides can be realized on the drying and/or cleaning cloth. Thereby both sides can consist of identical cloth layers, however different cloth layers with differing material properties can also be utilized for the two sides of the drying and/or cleaning cloth.

Preferably, at least one fleece surface can be formed by terrycloth, preferably fulled terrycloth, such that a both pleasant and well-absorbent surface is provided.

In a preferred embodiment example of the invention, the border region of the longitudinal edges and of the transverse edges can be hemmed with an edging made of a textile material and/or a seam positioned at a small distance from the respective edge be provided, where in the region of an opening if any that is provided in a transverse edge no edging is provided or it comprises only the edge of one side.

Furthermore, an opening provided not in a transverse edge can be hemmed with an edging made of a textile material, such that fraying of the drying and/or cleaning cloth in the region of the opening is avoided and the edging for its part is similarly as soft as the drying and/or cleaning cloth and hence does not cause impairment of or damage to the surface to be treated. Alternatively or additionally, a seam positioned at a small distance from the edge can also be provided.

Also, at least one side of the drying and/or cleaning cloth is configured as a microfiber cloth, preferably both sides of the drying and/or cleaning cloth each be configured as a microfiber cloth, such that an especially high absorbency with regard to dirt, dust, and moisture is provided.

According to the invention, at least one side of the drying and/or cleaning cloth can consist of a mixed fabric with polyester and polyamide constituents, preferably both sides of the drying and/or cleaning cloth can also each consist of a mixed fabric with polyester and polyamide constituents.

Thereby the mixed fabric can exhibit a composition with ca. 80% polyester and ca. 20% polyamide.

Preferably the drying and/or cleaning cloth can have an area density of ca. 800 g/m$^2$.

In a preferred embodiment example of the invention, the longitudinal edges can each have a length of ca. 25 cm to 50 cm, preferably a length of ca. 30 cm to 40 cm, and most preferably a length of ca. 34 cm or 35 cm.

Also, the longitudinal edges can have a distance from each other of ca. 15 cm to 30 cm, preferably a distance of ca. 20 cm to 25 cm, and most preferably a distance of ca. 22 cm or 23 cm.

In a preferred embodiment example of the invention, the drying and/or cleaning cloth can be configured mirror-symmetrically in the longitudinal direction and/or be configured mirror-symmetrically in the transverse direction.

Also, in at least one pentagonally configured region the tip formed by the front edge sections can project in the longitudinal direction of the drying and/or cleaning cloth relative to the end points of the longitudinal edges to which the front edge sections join at an obtuse angle by ca. 5 cm to 20 cm, preferably by ca. 10 cm to 15 cm, and most preferably by ca. 11 cm or 12 cm.

BRIEF DESCRIPTION OF THE DRAWINGS

In the following, embodiment examples of the invention shown in the drawings are explained. The figures show.

DETAILED DESCRIPTION OF THE PREFERRED EMBODIMENT(S)

In all figures, matching reference symbols are used for identical or similar components.

Figure 1:
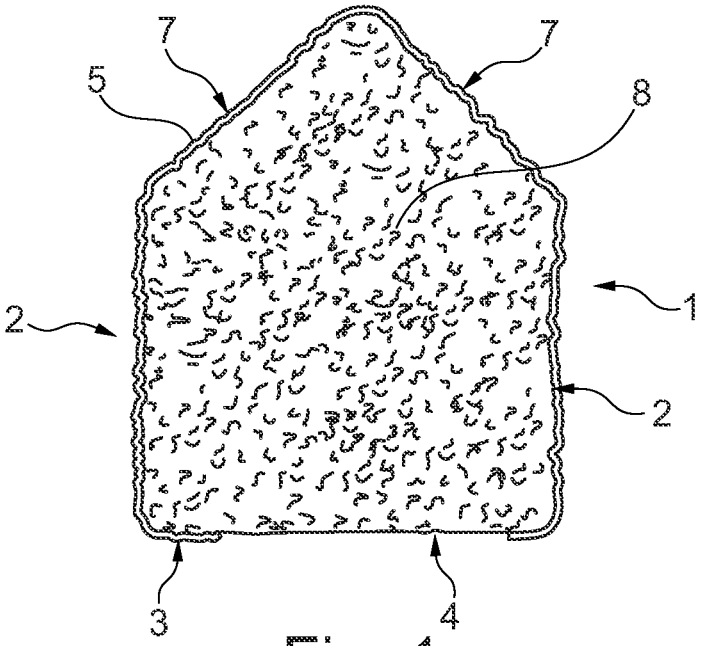
FIG. 1 A first embodiment example of a drying and/or cleaning cloth according to the invention, FIG. 2 A second embodiment example of a drying and/or cleaning cloth according to the invention, and FIG. 3 A part-view shown in section of the object according to FIG. 2.

FIG. 1 shows a drying and/or cleaning cloth 1 with an elongated shape with a double-layered construction with two sides 10, 11 each formed by cloth layers. Between these two sides 10, 11 there is located an interior region 9.

The two sides 10, 11 are each bounded by two parallel longitudinal edges 2 and two transverse edges 3, and an opening 4 is provided for reaching into the interior region 9 between the two sides 10, 11.

According to the invention, the drying and/or cleaning cloth 1 shown in FIG. 1 has a pentagonally configured region 8 and is formed solely by this region. In the pentagonally configured region 8, one of the two transverse edges 3 is aligned at right angles to the longitudinal edges 2, whereas the other of the two transverse edges 3 is formed by two angularly abutting front edge sections 7, respectively adjoining the corresponding longitudinal edges 2 at an obtuse angle.

In this embodiment example the opening 4 for reaching into the interior region 9 between the two sides 10, 11 is provided in the region of the transverse edge 3 aligned at right angles to the longitudinal edges 2 centrally between the longitudinal edges 2.

Hereby it is possible to reach with a flat hand into the interior region 9 and the anterior transverse edge 3 formed by the front edge sections 7 and forming a tip approximates the shape of the inserted hand. The middle finger of the inserted flat hand can thus be in the foremost tip and the other fingers including the thumb project less far forward and are then each sideways to the middle finger in the interior region 9.

The drying and/or cleaning cloth 1 is configured mirror-symmetrically in the longitudinal direction. The tip formed by the front edge sections 7 projects in the longitudinal direction relative to the end points of the longitudinal edges 2 to which they join by a length "I". Here the length "I" is smaller than the length "L" of the longitudinal edges 2, for example by a factor of 0.5 or 0.6.

The border region of the longitudinal edges 2 and of the transverse edges 3 is hemmed with an edging 5 made of a textile material, where however no edging 5 is provided in the region of an opening 4 if any that is provided in a transverse edge 3.

Figure 2:
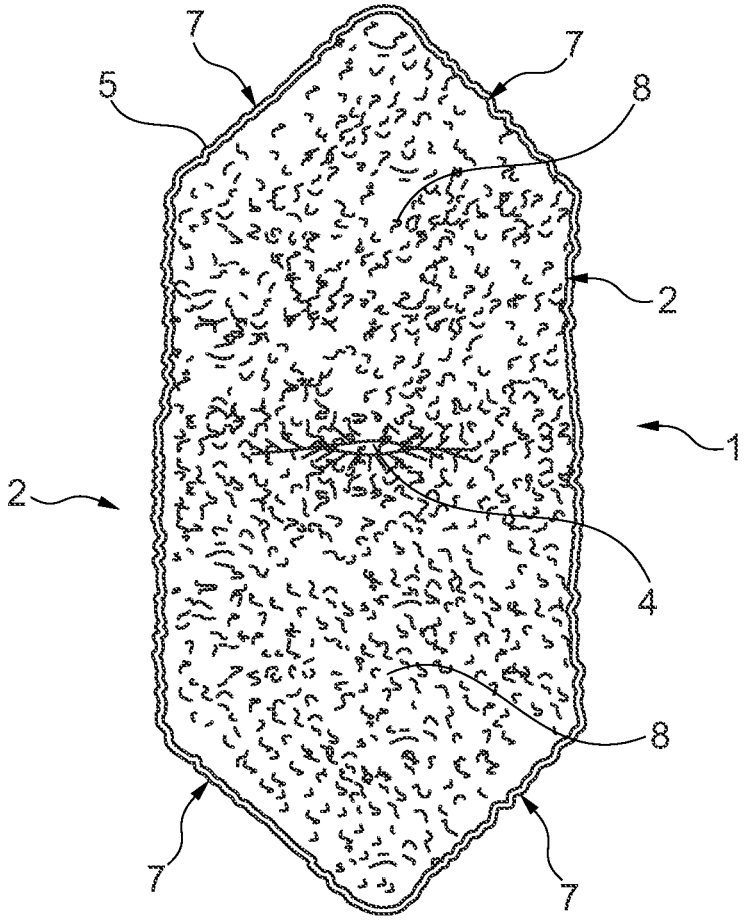

In the embodiment example shown in FIG. 2, the drying and/or cleaning cloth 1 has two pentagonally configured regions 8. These two pentagonally configured regions 8 are designed to be abutting each other and connected with each other with their respective formed transverse edge 3 aligned at right angles to the longitudinal edges 2 and not through front edge sections 7 adjoining the corresponding longitudinal edges 2 at an obtuse angle.

This results in a drying and/or cleaning cloth 1 with the shape of a hexagon, which although configured mirror-symmetrically in the longitudinal direction and also configured mirror-symmetrically in the transverse direction, does not represent a regular hexagon because the two longitudinal edges 2 designed in parallel to one another are each longer than the four front edge sections 7 and are also longer than the distance between the two parallel longitudinal edges 2.

Both sides 10, 11 of the drying and/or cleaning cloth 1 exhibit respectively a fleece surface, each of which is provided externally on the drying and/or cleaning cloth 1 for good sliding on the area to be treated.

The border region of the longitudinal edges 2 and the border region of the front edge sections 7 forming the outer transverse edges 3 are each hemmed with an edging 5 made of a textile material.

Thereby both sides 10, 11 of both pentagonally configured regions 8 of the drying and/or cleaning cloth 1 are each configured as one piece and continuously, such that as a result each side 10, 11 of the drying and/or cleaning cloth 1 is configured respectively as a one piece and continuous layer.

The opening 4 is here provided centrally in relation to the longitudinal extension of the drying and/or cleaning cloth 1, such that the two part-regions located in front or behind the opening 4 in the longitudinal direction are at least approximately of the same size.

Thereby the opening 4 is formed by a slit through both sides 10, 11 of the drying and/or cleaning cloth 1, such that both sides 10, 11 thus each exhibit two free slit edges and the openings 4 in both sides 10, 11 are congruent.

Figure 3:
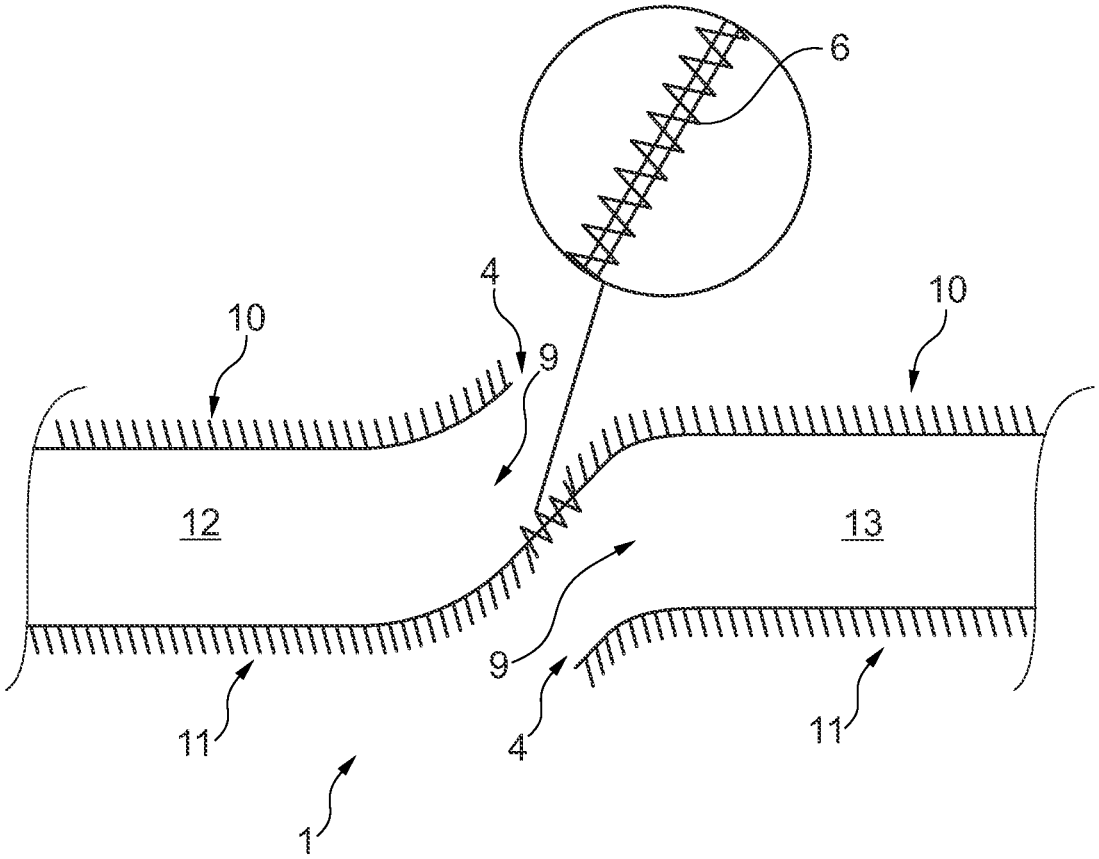

As is apparent from FIG. 3, the outer slit edge of one side 10 of one pentagonally configured region 8 is sewn to the outer slit edge of the other side 11 of the other pentagonally configured region 8. As shown in the detail enlargement of FIG. 3 as a top view, this can take place by means of a seam 6 configured as a zigzag seam along the one-another abutting outer slit edges of the two sides 10, 11.

As a result, the one side 10 of the one pentagonally configured region 8 then merges directly into the other side 11 of the other pentagonally configured region 8.

Hence, on each side 10, 11 it is possible to reach into the interior region 9 only in one direction, and the part-regions 12, 13 of the interior region 9 into which it is possible respectively to reach are different for the two sides 10, 11.

I claim:

1. A cloth (1) for at least one of drying and cleaning, the cloth (1) comprising:

two pentagonally configured regions (8), each region having an elongated shape and a double-layered construction with two sides (10, 11) formed respectively by cloth layers and an interior region (9) located in-between;

the two sides (10, 11) of each of the two pentagonally configured regions (8) are each bounded by two parallel longitudinal edges (2) and two transverse edges (3);

each of the two pentagonally configured regions (8) has an opening (4) configured for reaching into the interior region (9) between the two sides (10, 11) of each of the two pentagonally configured regions (8);

wherein the cloth (1) is formed solely by the two pentagonally configured regions (8);

the two pentagonally configured regions (8) abut each other and directly connect with each other;

wherein one of the two transverse edges (3) of each of the pentagonally configured regions (8) is aligned at right angles to the longitudinal edges (2) and the other of the two transverse edges (3) is formed by two angularly abutting front edge sections (7) adjoining the corresponding longitudinal edges (2) at an obtuse angle;

wherein the opening (4) for reaching into the interior region (9) between the two sides (10, 11) of each of two pentagonally configured regions (8) is in the region of the transverse edge (3) aligned at right angles to the longitudinal edges (2);

wherein one of the two sides (10, 11) of one of the pentagonally configured regions (8) is continuous and one piece with one of the two sides (10, 11) of another of the pentagonally configured regions (8);

wherein the opening (4) formed by a slit through both of the two sides (10, 11) of each of the two pentagonally configured regions (8) and thus both of the two sides (10, 11) exhibits two free slit edges; and wherein the slit edge of the one side (10) of one of the pentagonally configured regions (8) is sewn to the slit edge of the other side (11) of the other pentagonally configured region (8).

2. The cloth (1) according to claim 1, wherein the opening (4) of each of two pentagonally configured regions (8) has a length of 5 cm to 15 cm.

3. The cloth (1) according to claim 1, wherein at least one opening (4) is arranged approximately centrally in relation to the respective transverse edges (3) and exhibits the same distance respectively to each of the corresponding longitudinal edges (2).

4. The cloth (1) according to claim 1, wherein the opening (4) of each of two pentagonally configured regions (8) is provided centrally in relation to the longitudinal extension of the cloth (1).

5. The cloth (1) according to claim 1, wherein at least one of the sides (10, 11) of the cloth (1) has a fleece surface.

6. The cloth (1) according to claim 5, wherein each of the sides (10, 11) that exhibits a fleece side is provided with the fleece side facing outward.

7. The cloth (1) according to claim 5, wherein at least one fleece surface is formed by terrycloth.

8. The cloth (1) according to claim 1, wherein the border region of the longitudinal edges (2) and of the transverse edges (3) is hemmed with at least one of an edging (5) made of a textile material and a seam (6) positioned at a distance from the respective edge, where in the region of the opening (4) if any that is provided in the transverse edge (3) no edging (5) is provided or it comprises only the edge of one side (10, 11).

9. The cloth (1) according to claim 1, wherein the opening (4) provided not in the transverse edge (3) is hemmed with an edging (5) made of a textile material.

10. The cloth (1) according to claim 1, wherein at least one side (10, 11) of the cloth (1) is a microfiber cloth.

11. The cloth (1) according to claim 1, wherein at least one side (10, 11) of the cloth (1) is a mixed fabric with polyester and polyamide constituents.

12. The cloth (1) according to claim 11, wherein the mixed fabric has a composition with 80% polyester and 20% polyamide.

13. The cloth (1) according to claim 1, wherein the cloth (1) has an area density of 800 $g/m^2$.

14. The cloth (1) according to claim 1, wherein the longitudinal edges (2) each have a length of 25 cm to 50 cm.

15. The cloth (1) according to claim 1, wherein the longitudinal edges (2) have a distance from each other of 15 cm to 30 cm.

16. The cloth (1) according to claim 1, wherein the cloth (1) is configured mirror-symmetrically in the longitudinal direction and mirror-symmetrically in the transverse direction.

17. The cloth (1) according to claim 1, wherein in at least one of the pentagonally configured regions (8) a tip formed by the front edge sections (7) projects in the longitudinal direction of the cloth (1) by 5 cm to 20 cm relative to end points of the longitudinal edges (2) to which the front edge sections (7) join at the obtuse angle.

* * * * *